United States Patent [19]

Brunner et al.

[11] Patent Number: 4,479,128

[45] Date of Patent: Oct. 23, 1984

[54] POLARIZATION MEANS FOR GENERATING CIRCULARLY POLARIZED ELECTRO-MAGNETIC WAVES

[75] Inventors: Anton Brunner, Wangen; Klaus Rieskamp, Soecking, both of Fed. Rep. of Germany

[73] Assignee: Siemens Aktiengesellschaft, Berlin & Munich, Fed. Rep. of Germany

[21] Appl. No.: 281,323

[22] Filed: Jul. 8, 1981

[30] Foreign Application Priority Data

Jul. 17, 1980 [DE] Fed. Rep. of Germany ..... 3027094

[51] Int. Cl.[3] ..... H01Q 15/24

[52] U.S. Cl. ..... 343/756; 343/872; 343/909

[58] Field of Search ..... 343/756, 909, 872

[56] References Cited

U.S. PATENT DOCUMENTS 3,031,664 4/1962 Wielobob ..... 343/756
3,560,984 2/1971 Lee et al. ..... 343/756
3,754,271 8/1973 Epis ..... 343/756
3,831,176 8/1974 Epis et al. ..... 343/756
4,127,857 11/1978 Capps et al. ..... 343/756

*Primary Examiner*—Eli Lieberman
*Attorney, Agent, or Firm*—Hill, Van Santen, Steadman & Simpson

[57] ABSTRACT

A re-polarization means for generating circular polarized electro-magnetic waves using single or multi-layer lattice structure mounted in front of a radiation aperture with the lattice structure comprising a plurality of conductors which extend parallel to each other and/or meander shaped and wherein the lattice structure has one or more additional layers which are closer to the radiation aperture and which has a plurality of parallel conductors but that are inclined by an angle of 45° relative to the direction of the conductors mounted on the other layers which meander. Additionally, orthogonal polarization suppression is achieved with the apparatus of the invention. The invention can be applied to a radom of a target tracking radar antenna, for example.

10 Claims, 6 Drawing Figures

POLARIZATION MEANS FOR GENERATING CIRCULARLY POLARIZED ELECTRO-MAGNETIC WAVES

BACKGROUND OF THE INVENTION

1. Field of the Invention

This invention relates in general to re-polarization means for generating circular polarized electro-magnetic waves using a single or multi-layer lattice structure mounted in front of a radiation aperture and the lattice structure consisting of a plurality of conductors in the form of lines such as meander lines or the like which extend parallel to each other.

2. Description of the Prior Art

Because of the greater ease of construction to obtain linear polarization, primary radiators for example for search and target tracking radar antennas are generally constructed as linear polarized structures. Since the employment of circular polarization is desirable in radar applications so as to reduce reflection effects of rain clouds, the linear polarization of the antenna generally is converted by a lattice structure mounted in front of the antenna aperture to obtain circular polarization. Such polarization converters with lattice structures are shown, for example, in U.S. Pat. No. 3,754,271. According to this patent, meander lines extend at 45° to the E-vector of the incident wave and generate a phase difference due to the capacitance or respectively the inductance effect of the E-vector components which are perpendicular and parallel to them for which the phase difference of 90° necessary for polarization is achieved by using suitable dimensioning and layering.

Other types of lattice structures consist of straight lines at specific intervals in a plurality of layers as well as of line/rectangular combinations for generating circular polarization are known. Suppression or decoupling of the cross-polarization are in general of the orthogonal or de-polarization with respect to a desired linear or circular polarization is of great importance in many applications for example in order to avoid cross-talk wherein double polarization operation exist or in order to achieve the necessary precision in position finding systems. For this purpose, lattices with metal strips or wires extending perpendicular with respect to the E-vector can be employed in a known manner to obtain linear polarization. The cross-polarization component extending parallel to the wires is reflected and, thus, suppressed. By employing a plurality of such lattice layers, the amount of suppression of the cross-polarization components can be further increased.

SUMMARY OF THE INVENTION

It is an object of the present invention to convert the polarization of an antenna into a circular polarization using an integrated single lattice-like arrangement whereby the differing cross-polarization components distributed across the antenna aperture are suppressed during the conversion or the resulting polarization consisting of co-polarization and cross-polarization are converted into the pure desired polarization. The two objects of polarization conversion and orthogonal polarization suppression previously were executed with two separate devices and independently of each other.

According to the invention which relates to a re-polarization means of the type listed above, the object is achieved in that the lattice structure has one or more additional layers mounted closer to the radiation aperture with the layers respectively consisting of a lattice having conductors designed as straight lines that extend parallel to each other for purpose of obtaining linear polarization filtration such as in a direction which is inclined by 45° relative to the direction of the conductors which are meander line shaped. In total, the lattice structure is constructed such that first a linear polarization filtration is accomplished and subsequently, the radiation existing in the filtered linear polarization is converted into a radiation with circular polarization. In the linear polarization filtration, only that radiation component is allowed to pass which has a E-vector perpendicular to the straight line conductors which extend parallel to each other.

The inventive concept can be employed both for a planar polarization lattice as well as for a curved, for example, conically shaped lattice when the orientation of the conductor structure is related to the projection in one plane perpendicular to the primary radiation axis. In other words, the antenna axis.

In an advantageous manner, the circular polarizing conductors and the linear polarization filter conductors of the lattice structure are etched metal strips attached to a synthetic foil.

Layers of insulating material are used for maintaining the spacing between the individual foils with the layer of insulating material consisting of rigid expanded polyurethane or designed as a honeycomb structure.

The re-polarization device of the invention can be combined in an expedient manner with an aperture covering (Radome) of an antenna for example, of a target tracking radar antenna.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
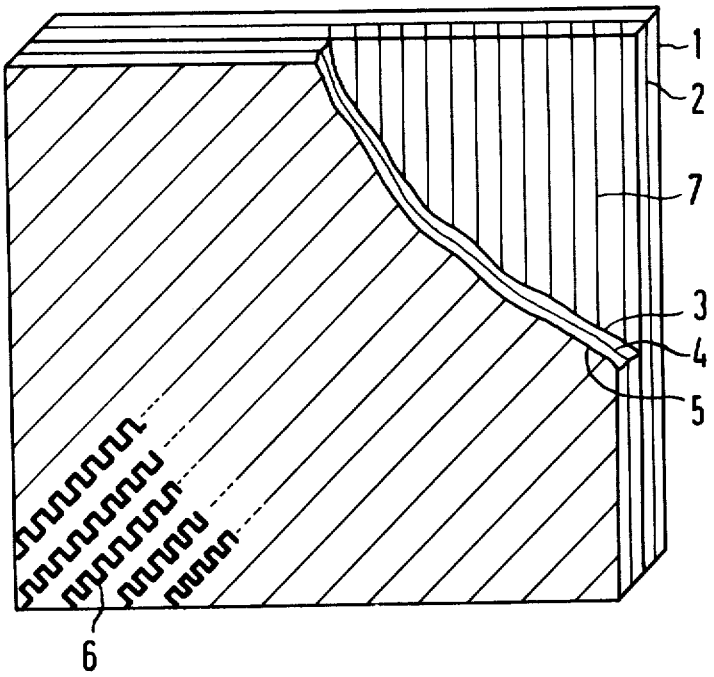
FIG. 1 is a partially cut-away perspective view of a lattice structure according to the invention.
Figure 2:
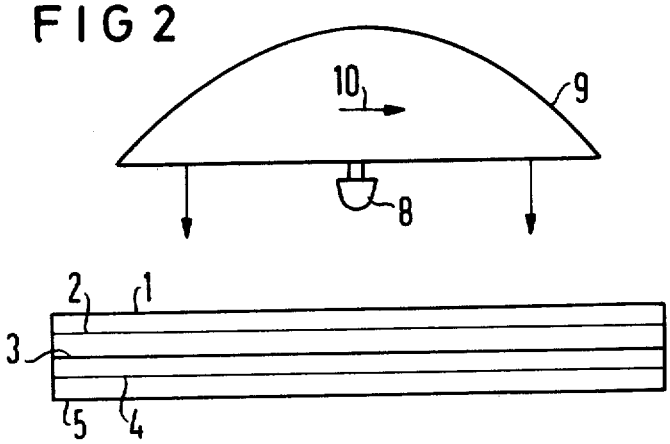
FIG. 2 is a top plan view of the invention shown in place in front of an antenna.

FIGS. 1 and 2 illustrate the lattice structure of the invention which consists of two layers 1 and 2 upon which a plurality of parallel straight line conductor tracks are formed. In addition, three layers 3, 4 and 5 are applied above the layers 1 and 2 upon which a plurality of parallel meander lines 6 are formed which extend parallel to each other. The direction of the parallel meander line 6 is 45° with respect to the straight tracks 7 on layers 1 and 2 as can be seen in FIG. 1 for example.

The combined lattice structure is placed in front of the radiation aperture of an antenna which consists of a primary radiator 8 and the reflector 9 as illustrated in FIG. 2. The primary radiator 8 emits linearly polarized radiation in a direction as indicated by arrow 10. Cross-polarization components occur upon reflection on the parabolic mirror 9. Radiation with linear polarization which is not ideal then strikes the lattice structure in front of the antenna aperture. The first two layers of the lattice structure are mounted as shown so as to intercept the radiation from the antenna and the first two layers 1 and 2 accomplish a linear polarization filtration so that only the radiation with the polarization indicated by arrow 10 is allowed to pass through to the layers 3, 4 and 5 due to the vertical alignment of the tracks 7 as illustrated in FIG. 1 which are applied to layers 1 and 2. The layers 3, 4 and 5 then cause the conversion of the ideal linear polarization impinging thereon into a circular polarization which has no orthogonal polarization components.

Figure 3:
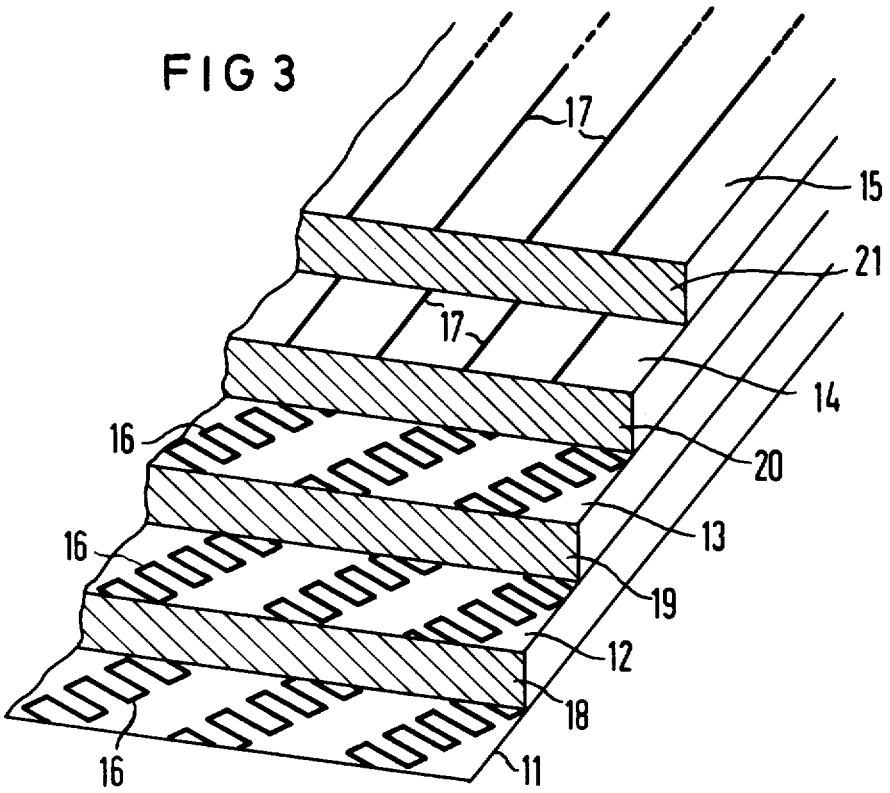
FIG. 3 is a partially cut-away perspective view showing sections of the device having five layers.

FIG. 3 is a sectional view of the polarization lattice of the invention showing five metal lattice structures mounted one above the other and which are formed on layers of synthetic foils 11, 12, 13, 14 and 15 respectively. The conductors 16 and 17 are formed on the foils 11, 12, 13, 14 and 15. Each of the three lattice structures 11, 12 and 13 consist of a multitude of parallel meander-shaped tracks 16 which extend at an orientation of 45° relative to the tracks 17 as illustrated. In a plan view, the tracks 16 applied to foil 12, for example, all extend parallel to each other and they lie between the tracks 16 which are applied to the foils 11 and 13. In other words, the tracks 16 on foil 12 fall in the gaps between the meander tracks 16 on foils 11 and 13. The two lattice structures on the synthetic foils 14 and 15 consist of a plurality of straight conductor tracks 17 as illustrated. So that a specific spacing can be observed between the coils 11 through 15, layers of insulating material 18, 19, 20 and 21 are disposed between the foils with the layers particularly for weight saving being formed of honeycomb structure. The overall thickness of the overall layer can amount to one-half wave length. The tracks 16 correspond to the tracks 6 in FIG. 1 and the tracks 17 correspond to the tracks 7 in FIG. 1.

Figure 4:
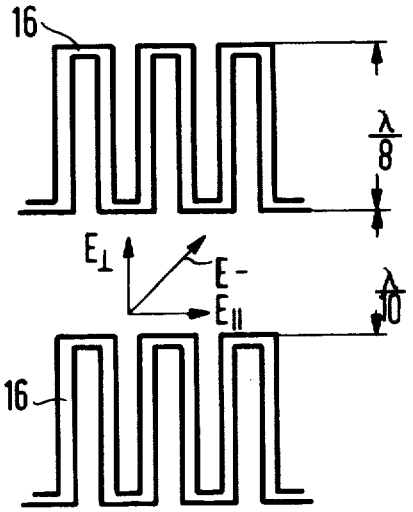
FIG. 4 is a plan view of a section of the meander-shaped conductors.
Figure 6:
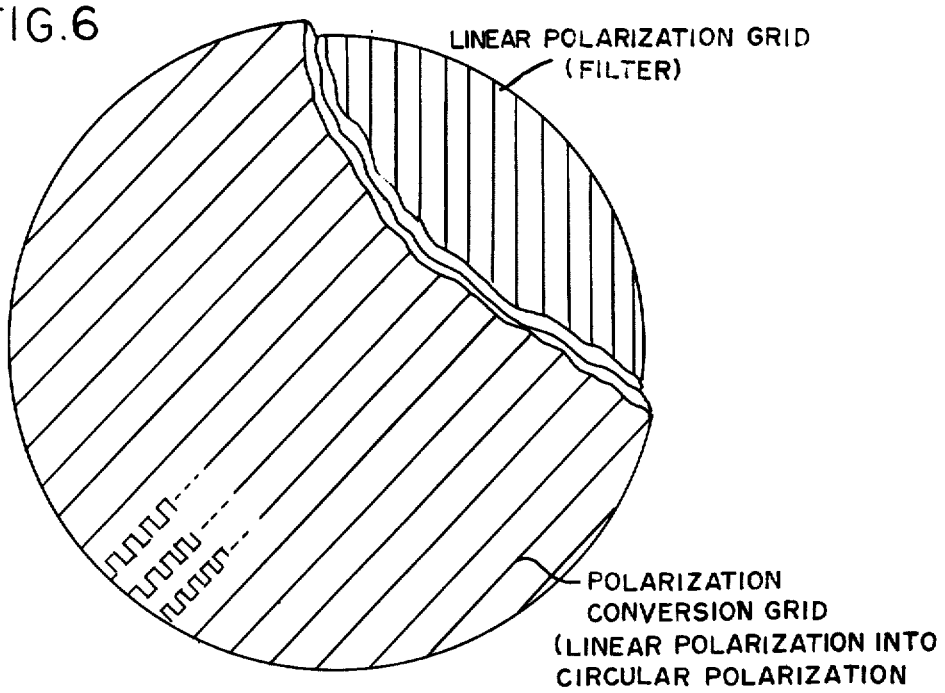
FIG. 6 shows a projection of the straight and meander lines on a surface perpendicular to the radiation axis.
Figure 5:
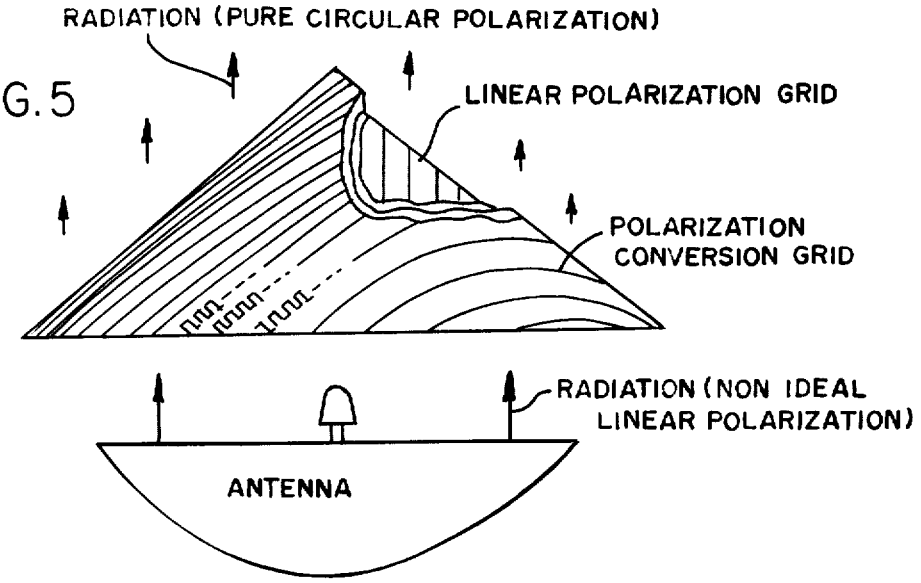
FIG. 5 shows a non-planar version of the device associated with a parabolic antenna.

FIG. 4 shows two parallel tracks 16 mounted on a foil and extending parallel to each other with respect to the direction of the E-vector existing at a particular location of the instant wave which has already been subjected to linear polarization by the layers 1 and 2 as illustrated in FIGS. 1 and 2. The meander shaped tracks 16 can have amplitudes or heights of one-eighth wave length and be spaced approximately one-tenth the wave length as illustrated in FIG. 4.

Thus, the present invention allows a composite structure comprising of two layers with straight tracks 7 or 17 as illustrated in FIGS. 1 and 3 and three layers with meandering tracks which extend at 45° to the straight tracks so as to convert the polarization of an antenna into circular polarization.

Although the invention has been described with respect to preferred embodiments, it is not to be so limited as changes and modifications can be made which are within the full intended scope of the invention as defined by the appended claims.

We claim as our invention:

1. A re-polarization means for the conversion of linearly polarized electro-magnetic waves into circularly polarized electro-magnetic waves upon employment of a device for linear polarization filtration and of a single-layer or multi-layer polarization conversion grid structure following the device for linear polarization and mounted in front of a radiation aperture and respectively consists of a plurality of conductors extending substantially parallel to each other in the form of straight lines, meander lines, line-rectangle combinations or the like, characterized in that the device for linear polarization filtration is a single-layer or multi-layer designed grid structure (1, 2) which precedes relative to the electro-magnetic waves the polarization conversion grid structure (3, 4, 5) in the direction toward the radiation aperture so that both grid structures are insulated from one another and are disposed so as to be above one another layer-by-layer in a substantially non-planar manner, and the grid structure layers forming the device for linear polarization filtration consists of straight-line conductors extending substantially parallel to each other and have a direction relative to the longitudinal direction of the conductors in the polarization conversion grid structure of 45°, and characterized in that, for a curved, non-planar lattice structure, the orientation of said straight lines for accomplishing linear polarization filtration and of said meander lines for accomplishing circularly polarization are shaped so that projection of them on one plane perpendicular to the primary radiation axis results in straight lines.

2. A re-polarization device according to claim 1, characterized in that said line conductors (7) for accomplishing linear polarization filtration and said meander conductors (6) for accomplishing circular polarization (16, 17) are etched metal strips mounted on respective synthetic foils (11 through 15).

3. A re-polarization means according to claim 2, including spacing layers of insulating material (18 through 21) mounted between the foils (11 through 15) and said spacing layers are made of insulating material consisting of rigid expanded polyurethane or are formed as honeycomb structures.

4. A re-polarization means according to claim 1 which is utilized as the aperture cover of an antenna.

5. A re-polarization means according to claim 4, characterized in that said antenna is a target tracking radar antenna with a covered reflector mirror and in said lattice structure is contained in the reflector aperture covering.

6. A re-polarization means for obtaining circular polarization according to claim 1 wherein said device for linear polarization filtration comprises, a first insulating sheet with a plurality of substantially parallel straight electrical conductors attached thereto, a second insulating sheet with a plurality of substantially parallel meander-shaped conductors mounted thereon with said first and second insulating sheets mounted adjacent to each other and wherein said straight conductors extend in a direction which makes an angle of 45 degrees to the direction of said meander-shaped conductors.

7. A re-polarization means according to claim 6 including a third insulating sheet with a plurality of substantially parallel straight electrical conductors mounted adjacent said first insulating sheet and said conductors on said first and third sheets extending substantially parallel to each other.

8. A re-polarization means according to claim 6 including a fourth insulating sheet with a plurality of meander-shaped conductors mounted adjacent said second insulating sheet and said meander-shaped conductors extending in the same directions as said meander-shaped conductors on said second sheet.

9. A re-polarization means according to claim 8 including a fifth insulating sheet with a plurality of meander-shaped conductors mounted adjacent said fourth sheet and said meander-shaped conductors extending in the same direction as said meander-shaped conductors on said second and fourth sheets.

10. A re-polarization means according to claim 9 wherein said fifth insulating sheet is mounted between said second and fourth sheets and wherein the meander-shaped conductors on said fifth insulating sheet in a plan view lie between the meander-shaped conductors on said second and fourth sheets.

* * * * *